US008561255B2

(12) United States Patent
Seo et al.

(10) Patent No.: US 8,561,255 B2
(45) Date of Patent: Oct. 22, 2013

(54) VACUUM CLEANER

(75) Inventors: Jinwook Seo, Changwon-si (KR); Jungmin Moon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 346 days.

(21) Appl. No.: 13/019,402

(22) Filed: Feb. 2, 2011

(65) Prior Publication Data

US 2011/0209301 A1 Sep. 1, 2011

Related U.S. Application Data

(60) Provisional application No. 61/301,210, filed on Feb. 4, 2010.

(51) Int. Cl.
*A47L 5/32* (2006.01)

(52) U.S. Cl.
USPC ..... 15/331; 15/334

(58) Field of Classification Search
USPC ..... 15/334, 331, 332, 335, 328
See application file for complete search history.

(56) References Cited

U.S. PATENT DOCUMENTS

| | | | | |
|---|---|---|---|---|
| 5,560,074 | A * | 10/1996 | Graham et al. | 15/323 |
| 6,079,077 | A * | 6/2000 | Kajihara et al. | 15/332 |
| 6,510,584 | B2 * | 1/2003 | Vystrcil et al. | 15/332 |
| 6,536,074 | B2 * | 3/2003 | Boles et al. | 15/331 |
| 7,555,810 | B2 * | 7/2009 | Pullins et al. | 15/331 |
| 7,559,112 | B2 * | 7/2009 | Lee et al. | 15/331 |
| 8,205,294 | B2 * | 6/2012 | Kim et al. | 15/331 |

* cited by examiner

*Primary Examiner* — Dung Van Nguyen
(74) *Attorney, Agent, or Firm* — Ked & Associates LLP

(57) ABSTRACT

Provided is a vacuum cleaner. The vacuum cleaner includes a suction nozzle and a main body rotatably connected to the suction nozzle.

14 Claims, 9 Drawing Sheets

VACUUM CLEANER

CROSS-REFERENCE TO RELATED APPLICATION

This application claims benefit of Provisional Application No. 61/301,210 filed Feb. 4, 2010, whose entire disclosure is incorporated herein by reference.

THE BACKGROUND

1. The Field

Embodiments relate to a vacuum cleaner.

2. Description of the Related Art

In general, vacuum cleaners are apparatuses, which suck air containing dusts using a suction force generated by a motor mounted within a main body to filter the dust in the main body.

The vacuum cleaners may be classified into a canister type cleaner in which a suction nozzle for sucking dusts on a floor is separated from a main body to connect the suction nozzle to the main body using a connection unit and an upright type cleaner in which a suction nozzle is integrated with a main body.

The upright type cleaner includes a suction nozzle for sucking air containing dusts while being moved along a floor, a main body rotatably coupled to the suction nozzle and including a suction motor therein, a handle disposed on an upper portion of the main body and grasped by a user during cleaning, and a dust collection unit mounted on the main body.

Also, movement wheels for easily moving the main body are disposed on the suction nozzle. A manipulation for allowing the main body to be rotated at a predetermined angle with respect to the suction nozzle is disposed on a rear side of the suction nozzle.

An operation of the vacuum cleaner will be briefly described below.

For performing a cleaning process, the manipulation part is manipulated to allow the main body to be inclined at a predetermined angle with the suction nozzle.

Then, when the vacuum cleaner is operated, a suction force is generated by the suction motor built in the main body. Thus, air containing dusts is sucked through the suction nozzle, and the sucked air is introduced into the dust connection unit.

The dusts separated from the air introduced into the dust collection unit are stored in the dust collection unit, and the air separated from the dusts is discharged from the dust collection unit. Then, the air is introduced into the main body and disposed from a side of the main body to the outside.

THE DETAILED DESCRIPTION

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Hereinafter, exemplary embodiments will be described in detail with reference to the accompanying drawings.

Figure 1:
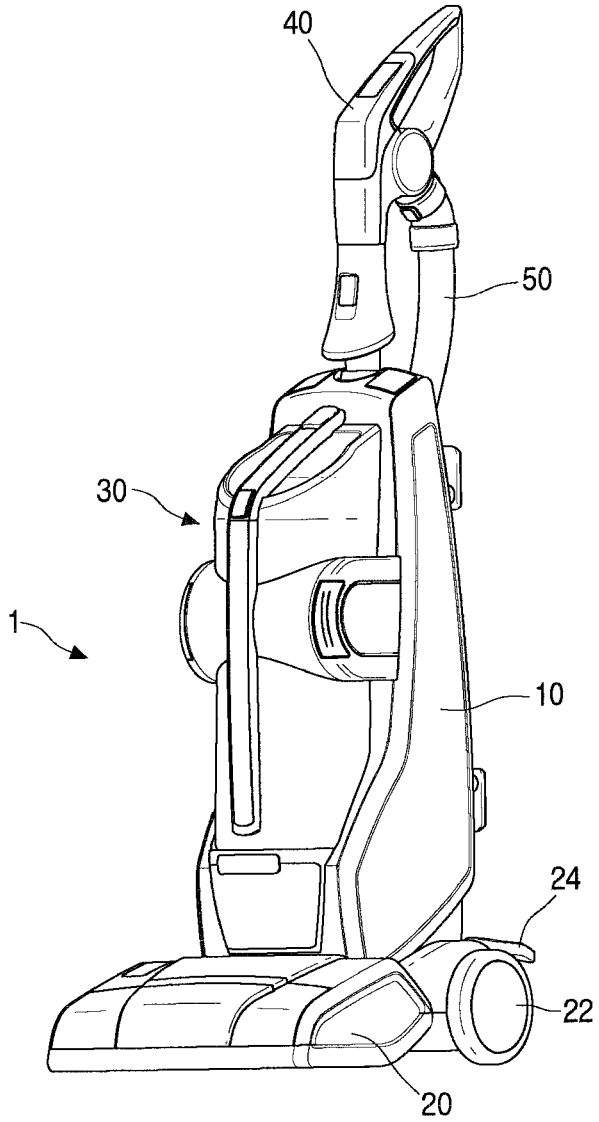
FIG. 1 is a rear perspective view of a vacuum cleaner according to an embodiment.
Figure 2:
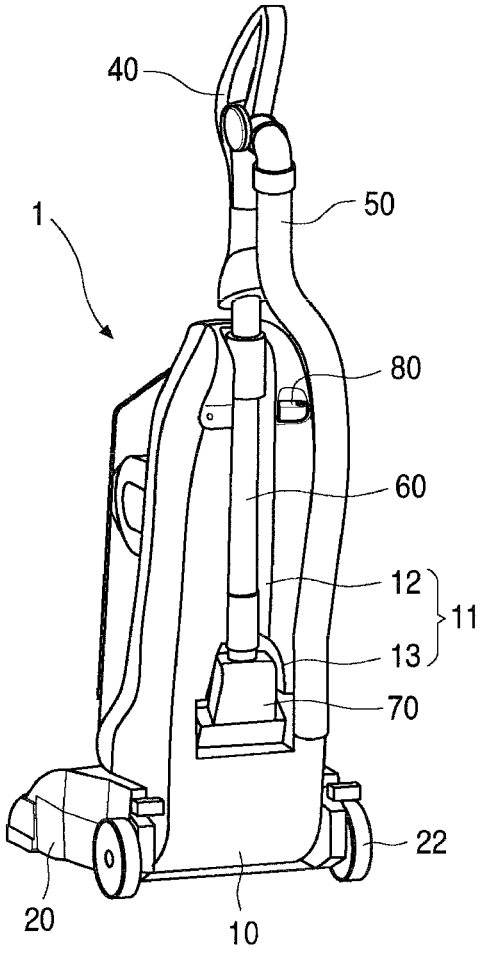
FIG. 2 is a rear perspective view of the vacuum cleaner according to an embodiment.
Figure 3:
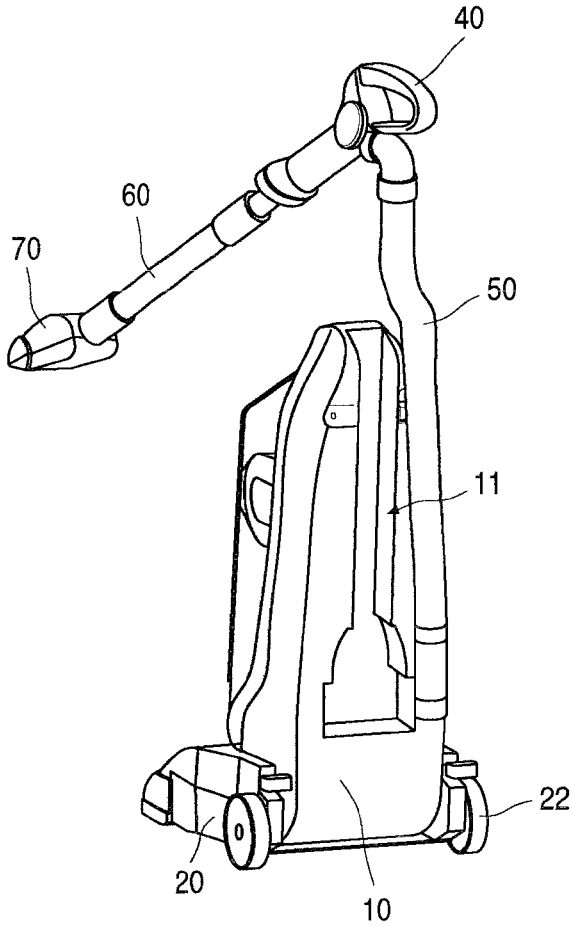
FIG. 3 is a rear perspective view of the vacuum cleaner from which a section suction unit is separated.

FIG. 1 is a rear perspective view of a vacuum cleaner according to an embodiment. FIG. 2 is a rear perspective view of the vacuum cleaner according to an embodiment. FIG. 3 is a rear perspective view of the vacuum cleaner from which a section suction unit is separated.

In the current embodiment, an upright type vacuum cleaner that is a kind of cleaner is disclosed.

Referring to FIGS. 1 to 3, a vacuum cleaner 1 according to an embodiment includes a main body 10 including a suction motor for generating a suction force, a first suction unit 20 rotatably connected to a lower portion of the main body 10 and placed on a floor, a dust separation unit 30 separably disposed on the main body 10, a second suction unit separably disposed on the main body 10 to clean the floor or portions except the floor, a handle disposed on an upper portion of the main body 10, and a connection hose 50 connecting the handle 40 to the main body 10.

In detail, a suction hole (not shown) for sucking dusts and air on the floor is defined in a bottom surface of the first suction unit 20. Wheels 22 for easily moving the first suction unit 20 are disposed on both sides of the first suction unit 20.

A manipulation part 24 is disposed at a rear side of the first suction unit 20 to allow the main body 10 to be rotated with the first suction unit 20 in a state where the main body 10 stands upright.

Thus, when the manipulation part 24 is operated, the main body 10 is rotated with respect to the first suction unit 20. Then, a user grasps the handle 40 to clean the floor while moving the first suction unit 20.

The dust separation unit 30 is selectively mounted on a front side of the main body 10, and the second suction unit is selectively mounted on a rear side of the main body 10.

The dust separation unit 30 separates dusts from air sucked into the main body 10 to store the separated dusts.

The second suction unit includes a nozzle 70 for cleaning the floor or portions except the floor and a suction tube 60 connecting the nozzle 70 to the handle 40.

A recessed mounting part 11 on which the second suction unit mounted is disposed in a back surface of the main body 10.

A suction tube mounting part 12 for mounting the suction tube 60 and a nozzle mounting part 13 for mounting the nozzle 70 are disposed on the mounting part 11. According to the current embodiment, since the nozzle 70 is mounted on the main body 10, it is unnecessary to separately store the nozzle 70.

Also, since the nozzle 70 is mounted on the main body 10 in a state where the nozzle 70 is connected to the suction tube 60, it is unnecessary to connect the nozzle 70 to the suction tube 60 so as to utilize the nozzle 70.

A passage (not shown) in which the dusts and air sucked through the nozzle 70 flow is disposed inside the handle 40. The connection hose 50 moves the dusts and air sucked through the nozzle 70 into the main body 10.

The connection hose 50 may be adjusted in length and formed of a movably flexible material.

An operation of the vacuum cleaner according to the current embodiment will be briefly described below.

Since a general upright vacuum cleaner should clean a floor while a suction unit connected to a lower portion of a main body is moved along the floor, it is difficult to clean places except the floor.

However, according to the current embodiment, the second suction unit may be separately coupled to the main body 10 to clean spaces except the floor.

When the second suction unit is separated from the main body 10, the floor or the portions except the floor may be cleaned using the second suction unit.

In detail, as shown in FIG. 1, for cleaning the floor, the main body 10 is rotated with the first suction unit 20 in a state where the second suction units 60 and 70 are coupled to the main body 10. Then, the user may clean the floor while moving the first suction unit 20 along the floor.

On the other hand, for cleaning the portions except the floor, as shown in FIG. 3, the second suction units 60 and 70 are separated from the main body 10 in a state where the main body 10 stands upright to suck the air containing the dusts using the second suction units 60 and 70.

Figure 4:
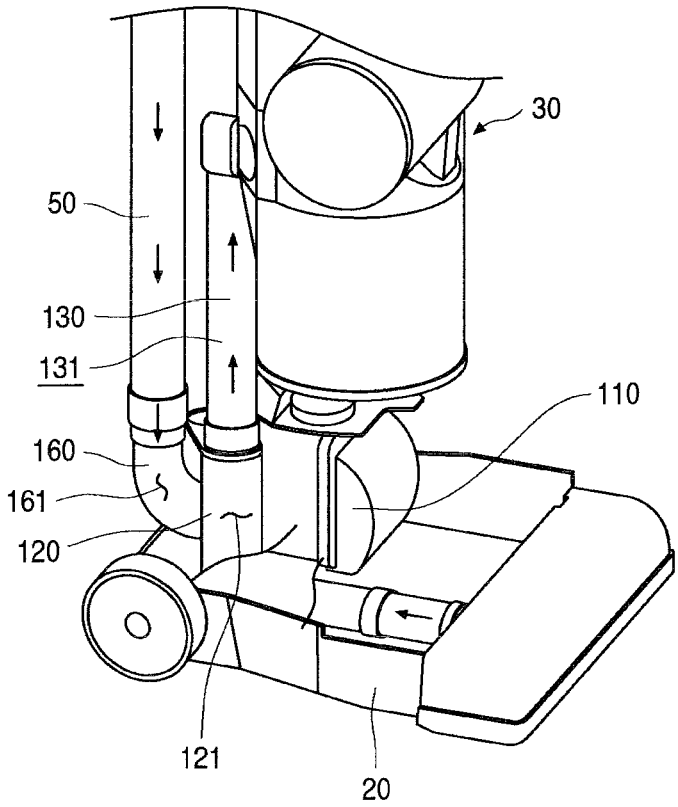
FIG. 4 is a perspective view of a passage structure within a main body according to an embodiment.

FIG. 4 is a perspective view of a passage structure within a main body according to an embodiment.

Referring to FIG. 4, a suction motor for generating a suction force is disposed inside the main body 10. A rotation shaft (not shown) for allowing the main body 10 to be rotated with respect to the first suction unit 20 is disposed on both sides of the main body 10.

The main body 10 includes a first suction passage tube 120 including a first suction passage 121 in which the air and dusts sucked into the first suction unit 20 flow and a second suction passage tube 160 including a second suction passage 161 in which the air and dusts sucked into the second suction unit flow.

Also, the main body 10 includes a connection passage tube 130 including a connection passage 131 for moving the air and dusts within the first suction passage 121 or the second suction passage 161 into the dust separation unit 30.

The first suction unit 20 includes a passage opening/closing unit 200 for opening or closing the first suction passage 121.

Hereinafter, the passage opening/closing unit will be described in detail.

Figure 5:
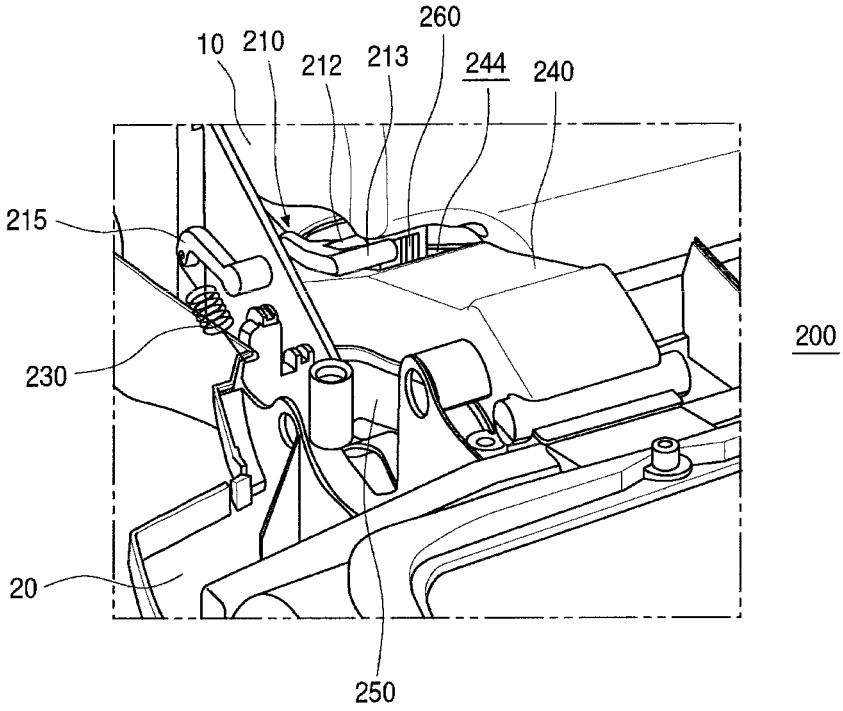
FIG. 5 is a perspective view of a first suction unit including a passage opening/closing unit according to an embodiment.
Figure 6:
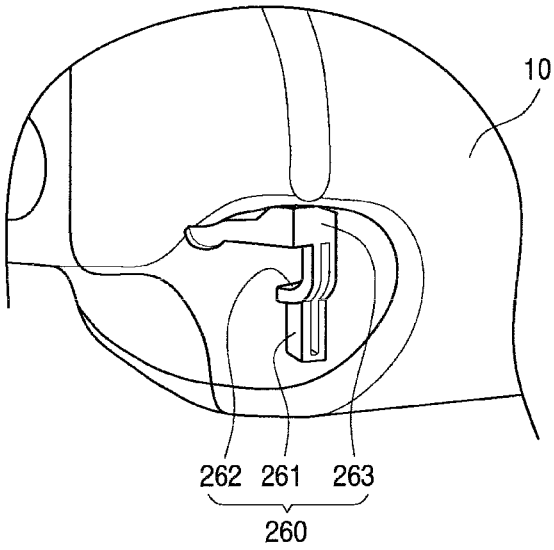
FIG. 6 is a perspective view of a push member included in a main body according to an embodiment.
Figure 7:
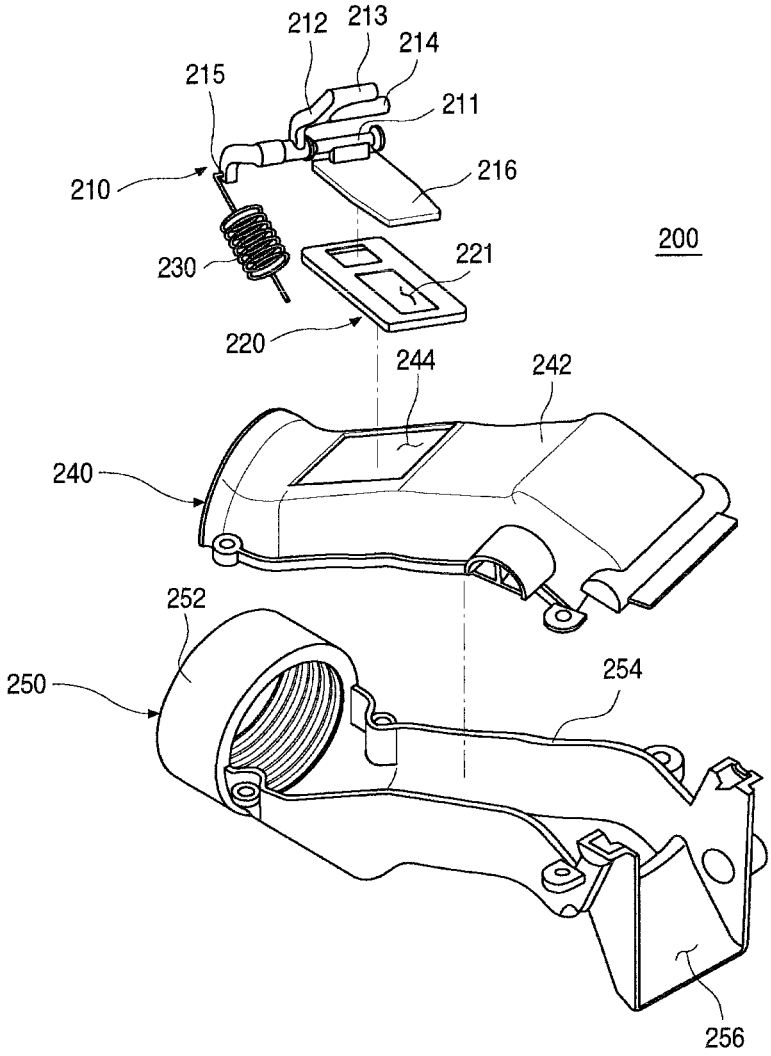
FIG. 7 is an exploded perspective view of the passage opening/closing unit according to an embodiment.

FIG. 5 is a perspective view of a first suction unit including a passage opening/closing unit according to an embodiment. FIG. 6 is a perspective view of a push member included in a main body according to an embodiment. FIG. 7 is an exploded perspective view of the passage opening/closing unit according to an embodiment.

Referring to FIGS. 5 to 7, the first suction unit 20 includes the passage opening/closing unit 200. The passage opening/closing unit 200 includes air guides 240 and 250 communicating with the first suction passage 121, an opening/closing member 210 for opening or closing an inner passage of the air guides 240 and 250, a sealer 220 coupled to the opening/closing member 210, and an elastic member 230 coupled to the opening/closing member 210 to generate a position restoring force by an elastic force.

In detail, the air guides 240 and 250 include an upper air guide 240 and a lower air guide 250 coupled to the upper air guide 240.

An opening 244 through which a push member 260 (that will be described later) for operating the opening/closing member 210 passes is defined in a body 242 of the upper air guide 240.

A connection member 252 connected to the first suction tube 120 through screw-coupling is disposed on one end of the body 254 of the lower air guide 250. A suction hole 256 communicating with the suction hole (not shown) defined in the bottom surface of the first suction unit 20 is defined in the other end of the body 254.

The opening/closing member 210 includes a rotation shaft 211 coupled to the first suction unit 20 and serving as a center of a vertical rotation, an opening/closing plate 216 extending from the rotation shaft 211, a rotation guide 214 extending from the rotation shaft 211 and coupled to the push member 260 to forcibly rotating the opening/closing plate 216, a pressing part 213 extending from the rotation shat 211 to maintain the upright state of the main body 10, and a coupling part 215 extending an end of the rotation shaft 211 and coupled to the elastic member 230.

In detail, the rotation shaft 211 has a long rod shape. The rotation shaft 211 has one end coupled to the first suction unit 20. Also, the coupling part 215 is disposed on the other end of the rotation shaft 211.

An extension part 212 extending in a direction crossing an extending direction of the rotation shaft 211. The pressing part 213 extends in a direction crossing the extending direction of the extension part 212. Thus, the pressing part 213 and the rotation guide 214 extend parallel to the extending direction of the rotation shaft 211.

The coupling part 215 is coupled to the elastic member 230. The elastic member 230 applies an elastic force to the rotation shaft 211 so that the opening/closing plate 221 is rotated in a direction in which the passage of the air guides 240 and 250 is opened.

The opening/closing plate 216 is disposed inside the air guides 240 and 250.

The opening/closing plate 216 has an approximately square plate shape and is coupled to the sealer 220.

The sealer 220 is formed of a flexible material. For example, in the current embodiment, the sealer 220 may be formed of a rubber material. A through hole 221 is defined in the sealer 220. The push member 260 presses the opening/closing plate 216 exposed by the through hole 221.

When the main body 10 is rotated backward to clean the floor, the sealer 220 seals the opening 244 to prevent the air sucked into the air guides 240 and 250 from leaking through the opening 244.

Referring to FIG. 6, the push member 260 extends downward from a lower portion of the main body 10.

The push member 260 includes a push part 261 pressing the opening/closing member 210 according to the rotation of the main body 10, a guide part 262 selectively hung on the rotation guide 214 to guide the rotation of the opening/closing member 210, and a stopper 263 contacting the pressing part 213 to prevent the main body 10 from falling backward when the main body 10 stands upright.

The push part 261 selectively passes through the opening 244 to push the opening/closing plate 216. When the main body 10 is rotated at a predetermined angle with respect to the first suction unit 20, the guide part 262 pulls the rotation guide 214 to forcibly rotate the rotation shaft 211.

Figure 8:
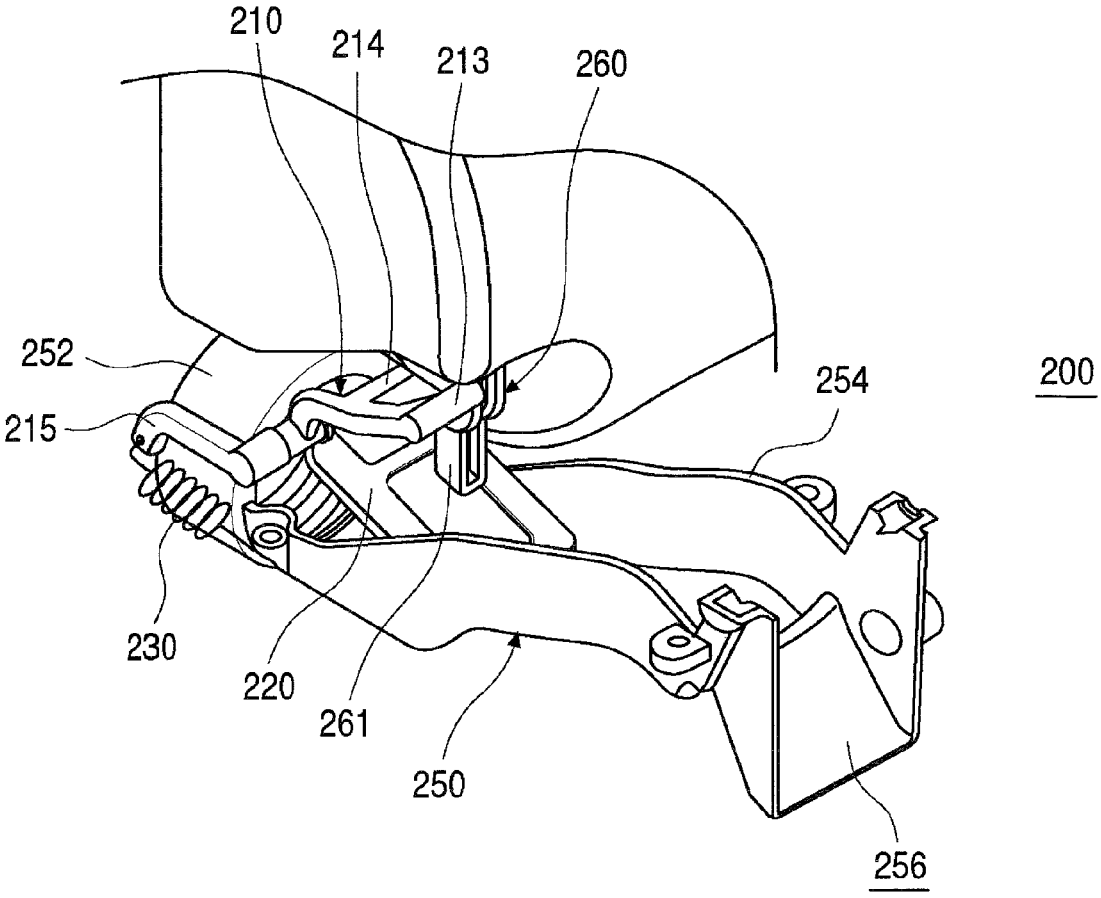
FIGS. 8 and 9 are views illustrating a state of the passage opening/closing unit in a state where the main body stands upright.
Figure 9:
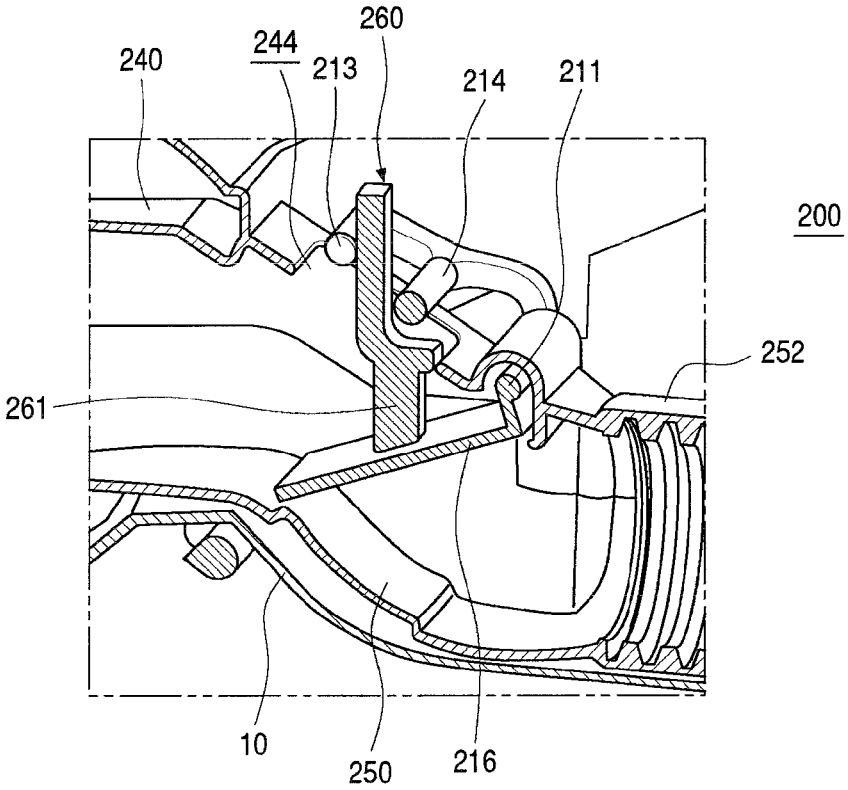

FIGS. 8 and 9 are views illustrating a state of the passage opening/closing unit in a state where the main body stands upright.

Referring to FIGS. 4 to 9, for performing the cleaning process using the second suction unit, the main body 10 stands upright.

Then, the push part 261 passes through the opening 244 of the air guides 240 and 250 to push the opening/closing plate 216.

Then, the opening/closing plate 216 is rotated with respect to the rotation shaft 211 to close the inner passage of the air guides 240 and 250.

In the current embodiment, since the insides of the air guides 240 and 250 communicates with the first suction passage 121, the closing of the inner passage of the air guides 240 and 250 may represent the closing of the first suction passage 121.

In this state, the pressing part 213 presses the stopper 263 to prevent the main body 10 from being rotated.

When the main body 10 stands upright, the dusts sucked through the second suction unit is moved into the dust separation unit 30 through the second suction passage 161 and the connection passage 131. On the other hand, since the air guides 240 and 250 are closed by the opening/closing plate 216, air is not sucked through the suction hole defined in the bottom surface of the first suction unit 20.

Figure 10:
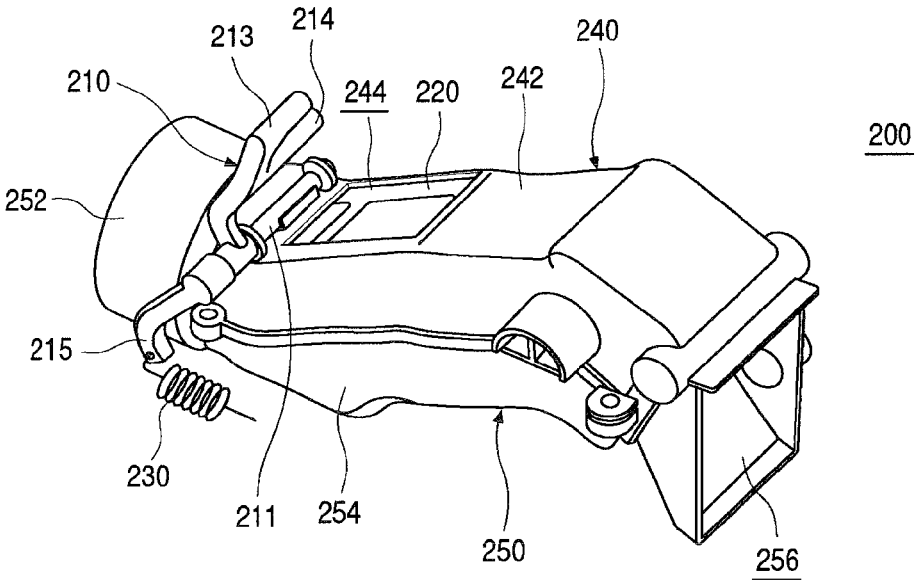
FIG. 10 is a sectional view illustrating a state of the passage opening/closing unit in a state where the main body is inclined with respect to the first suction unit.

FIG. 10 is a sectional view illustrating a state of the passage opening/closing unit in a state where the main body is inclined with respect to the first suction unit.

Referring to FIGS. 4 to 10, for utilizing the first suction unit 20, the main body 10 is rotated with respect to the first suction unit 20.

When the main body 10 is rotated, the push part 261 is spaced from the opening/closing plate 216 to release the pressing force applied to the opening/closing plate 216.

Thus, the opening/closing plate 216 is rotated by the restoring force of the elastic member 230 in a direction in which the opening 244 of the air guides 240 and 250 is closed. Simultaneously, when the main body 10 is rotated, the guide part 262 pulls the rotation guide 214, and thus, the opening/closing plate 216 is rotated with respect to the rotation shaft 211. That is, according to the current embodiment, the rotation shaft 211 is rotated by the restoring force of the elastic member 230 and a rotation moment transmitted by the rotation guide 214.

If the rotation guide 214 is not provided, the opening/closing plate 216 may not be rotated by an air pressure within the air guides 240 and 250. However, according to the current embodiment, since the guide part 262 pulls the rotation guide 214, the opening/closing plate 216 may be forcibly rotated.

When the main body 10 is rotated, the opening/closing plate 216 opens the passage of the air guides 240 and 250, and simultaneously, the opening/closing plate 216 closes the opening 244.

Then, the air and dusts sucked through the suction hole of the first suction unit 20 flow into the air guides 240 and 250. Thereafter, the air and dusts pass through the connection passage and are moved into the dust separation unit.

In the current embodiment, when the cleaning process is performed using the first suction unit 20, the second suction unit is mounted on the main body 10. In this state, since the suction hole of the second suction unit is substantially closed by the main body 10, air is not nearly sucked through the second suction unit.

According to the current embodiment, since the inner passage of the air guides is opened or closed corresponding to the rotation of the main body, the inner passage of the air guides may be precisely opened or closed.

Also, when the main body is rotated, since the opening/closing member is forcibly pulled, the air guides may be always maintained in the open state in the sate where the main body is rotated.

What is claimed is:

1. A vacuum cleaner, comprising:
- a main body comprising a suction motor that generates a suction force;
- a first suction device rotatably connected to the main body;
- a second suction device separably disposed on the main body;
- a first suction passage through which air sucked through the first suction device flows;
- a second suction passage through which air sucked through the second suction device flows, the second suction passage communicating with the first suction passage;
- an air guide disposed in the first suction device to communicate with the first suction passage;
- an opening/closing member that opens or closes the air guide; and
- a push member disposed in the main body to selectively press the opening/closing member, wherein the air guide has an opening through which the push member passes to operate the opening/closing member.

2. The vacuum cleaner according to claim 1, wherein the opening/closing member comprises a rotation shaft and an opening/closing plate that extends from the rotation shaft to open or close the air guide, and
- wherein the opening/closing plate is disposed inside the air guide.

3. The vacuum cleaner according to claim 2, further comprising an elastic member connected to the rotation shaft to apply an elastic force to the rotation shaft in a direction in which the opening/closing plate closes the opening.

4. The vacuum cleaner according to claim 2, further comprising:
- a rotation guide that extends from the rotation shaft; and
- a guide member disposed on the push member to pull the rotation guide when the main body is rotated in one direction.

5. The vacuum cleaner according to claim 4, wherein the rotation shaft comprises an extension that extends in a direction crossing an extending direction of the rotation shaft, and
- wherein the rotation guide extends from the extension a direction crossing the extension.

6. The vacuum cleaner according to claim 2, further comprising:
- a pressing member that extends from the rotation shaft; and
- a stopper disposed on the push member, the stopper being pressed by the pressing member in a state where the main body stands upright.

7. The vacuum cleaner according to claim 2, wherein the opening/closing plate closes the air guide in a state where the main body stands upright and, when the main body is rotated with respect to the first suction device, the opening/closing plate opens the air guide and closes the opening.

8. A vacuum cleaner, comprising:
- a main body comprising a suction motor that generates a suction force;

a suction device rotatably connected to the main body;

a suction passage through which air sucked through the suction device flows;

an air guide disposed in the suction device to communicate with the suction passage, the air guide having an opening;

an opening/closing member comprising an opening/closing plate disposed within the air guide; and a push member disposed in the main body to selectively press the opening/closing member, wherein the opening/closing member comprises a rotation shaft providing a rotation center of the opening/closing plate and a rotation guide that extends from the rotation shaft, and wherein the push member comprises a guide member that pulls the rotation guide when the main body is rotated in one direction.

9. The vacuum cleaner according to claim 8, wherein the push member passes through the opening to selectively press the opening/closing plate.

10. The vacuum cleaner according to claim 8, wherein the opening/closing plate interrupts an airflow in the air guide in a state where the main body stands upright and, when the main body is rotated with respect to the suction device, the opening/closing plate closes the opening.

11. The vacuum cleaner according to claim 8, further comprising an elastic member connected to the opening/closing member to apply an elastic force to the opening/closing member in a direction in which the opening/closing plate closes the opening.

12. The vacuum cleaner according to claim 8, wherein the rotation shaft comprises an extension that extends in a direction crossing an extending direction of the rotation shaft, and wherein the rotation guide extends from the extension a direction crossing the extension.

13. The vacuum cleaner according to claim 8, wherein the opening/closing member further comprises a pressing member that extends from the rotation shaft, and wherein the push member further comprises a stopper pressed by the pressing member in a state where the main body stands upright.

14. A vacuum cleaner, comprising:

a main body comprising a suction motor that generates a suction force;

a suction device rotatably connected to the main body;

a suction passage through which air sucked through the suction device flows;

an air guide disposed in the suction device to communicate with the suction passage, the air guide having an opening;

an opening/closing member comprising an opening/closing plate disposed within the air guide; and a push member disposed in the main body to selectively press the opening/closing member, wherein the push member passes through the opening to selectively press the opening/closing plate.

* * * * *